US010029140B2

(12) United States Patent
Douglass et al.

(10) Patent No.: US 10,029,140 B2
(45) Date of Patent: Jul. 24, 2018

(54) WRIST AND FOREARM EXERCISE DEVICE

(71) Applicant: Clipper Inc, Tokyo (JP)

(72) Inventors: Ian Clinton Douglass, Southfield, MI (US); Yumiko Tochigi, Tokyo (JP)

(73) Assignee: CLIPPER INC, Tokyo (JP)

( * ) Notice: Subject to any disclaimer, the term of this patent is extended or adjusted under 35 U.S.C. 154(b) by 0 days.

(21) Appl. No.: 15/343,111

(22) Filed: Nov. 3, 2016

(65) Prior Publication Data

US 2017/0120104 A1 May 4, 2017

Related U.S. Application Data

(60) Provisional application No. 62/351,743, filed on Jun. 17, 2016, provisional application No. 62/250,060, filed on Nov. 3, 2015.

(51) Int. Cl.

| | |
|---|---|
| ***A63B 21/072*** | (2006.01) |
| ***A63B 21/075*** | (2006.01) |
| ***A63B 21/00*** | (2006.01) |
| ***A63B 21/015*** | (2006.01) |
| ***A63B 23/035*** | (2006.01) |
| ***A63B 23/14*** | (2006.01) |
| *A63B 21/005* | (2006.01) |
| *A63B 21/055* | (2006.01) |

(Continued)

(52) U.S. Cl.

CPC .... *A63B 21/4035* (2015.10); *A63B 21/00069* (2013.01); *A63B 21/015* (2013.01); *A63B 21/4049* (2015.10); *A63B 23/03533* (2013.01); *A63B 23/14* (2013.01); *A63B 21/0052* (2013.01); *A63B 21/00065* (2013.01); *A63B 21/0552* (2013.01); *A63B 21/06* (2013.01); *A63B 2023/003* (2013.01)

(58) Field of Classification Search

CPC . A63B 21/4035; A63B 21/4049; A63B 23/14; A63B 23/03533; A63B 21/015; A63B 21/00069; A63B 21/0552; A63B 21/00065; A63B 21/0052; A63B 2023/003; A63B 21/06

USPC ..... 482/106–108, 114–120

See application file for complete search history.

(56) References Cited

U.S. PATENT DOCUMENTS 4,461,473 A * 7/1984 Cole ..... A63B 21/0004 482/106

4,618,143 A * 10/1986 Twardosz ..... A63B 21/0724 482/106

(Continued)

*Primary Examiner* — Garrett Atkinson

(57) ABSTRACT

A portable exercise device which applies a torsional force onto the user's hands in order to engage the forearm. The exercise device includes a first grip assembly, a second grip assembly, a planar framing body, and an adjustable resistance mechanism. The first grip assembly and the second grip assembly allow the user to engage the exercise device and are positioned offset to each other across the planar framing body. The first grip assembly and the second grip assembly each include a circular hole, an elongated handle, and a rotating ring. The circular hole traverses through the planar framing body. The rotating ring is perimetrically and slidably engaged to the planar framing body within the circular hole. The elongated handle is diametrically mounted across the rotating ring. The adjustable resistance mechanism produces the resistance force and is mechanically integrated in between the rotating ring and the planar framing body.

10 Claims, 5 Drawing Sheets

(51) Int. Cl.
*A63B 21/06* (2006.01)
*A63B 23/00* (2006.01)

(56) References Cited

U.S. PATENT DOCUMENTS 4,629,184 A * 12/1986 Selkee ..... A63B 21/0724 482/106
4,690,400 A * 9/1987 Metz ..... A63B 21/015 482/106
4,743,018 A * 5/1988 Eckler ..... A63B 21/0724 482/106
4,822,035 A * 4/1989 Jennings ..... A63B 21/0724 482/106
RE33,218 E * 5/1990 Twardosz ..... A63B 21/0724 482/106
5,024,434 A * 6/1991 Smith ..... A63B 21/0724 482/106
5,334,113 A * 8/1994 Roepke ..... A63B 21/0724 482/106
5,735,779 A * 4/1998 Lay ..... A63B 21/072 482/93
6,022,300 A * 2/2000 Hightower ..... A63B 21/0724 482/106
6,450,928 B1 * 9/2002 Larkins, Jr. ..... A63B 21/0608 482/106
7,094,186 B2 * 8/2006 Diakonov ..... A63B 21/0724 482/104
7,862,486 B1 * 1/2011 Watson ..... A63B 21/0724 482/106
7,896,777 B2 * 3/2011 Huang ..... A63B 21/0724 482/108
7,967,021 B2 * 6/2011 Montgomery ..... A45B 3/00 135/66
D654,544 S * 2/2012 Sliemers ..... D21/662
8,556,781 B1 * 10/2013 Fitzpatrick ..... A63B 21/0724 482/106
8,845,500 B2 * 9/2014 Huang ..... A63B 21/015 482/121
2017/0304669 A1 * 10/2017 LaCaze ..... A63B 21/023

* cited by examiner

WRIST AND FOREARM EXERCISE DEVICE

The current application claims a priority to the U.S. Provisional Patent application Ser. No. 62/351,743 filed on Jun. 17, 2016 and a priority to the U.S. Provisional Patent application Ser. No. 62/250,060 filed on Nov. 2, 2015.

FIELD OF THE INVENTION

The present invention relates generally to exercise equipment. More specifically, the present invention is a wrist and forearm exercise device. The present invention is a free-weight which utilizes a pair of rotating handle assemblies in conjunction with a resistance element in order to stimulate and engage the muscles of the forearm.

BACKGROUND OF THE INVENTION

There are a variety of exercise devices designed to target specific muscle groups in order to allow the user to customize a workout according to his or her personal preference and athletic ability. Additionally, such devices are ideal for rehabilitation purposes as they allow the user to slowly and gradually strengthen specific regions of the body. Some exercise devices are mounted to the ground and some are portable. Portable and/or at-home resistance exercise devices are becoming increasingly popular due to their customizable nature and low maintenance. There exists a variety of devices designed to target a variety of muscle groups. An objective of the present invention is to provide an exercise device that targets and engages the muscles of the forearm.

The present invention is a portable and adjustable exercise device for the wrist and forearm. The present invention utilizes two rotating handles in conjunction with an adjustable resistance mechanism in order apply a torsional force onto the user's arm. More specifically, the user simply grabs the handles and twist them repeatedly in either clockwise or counter clockwise direction in order to force the muscles of the forearm to engage and compensate. This action is ideal for martial arts training, climbing training, and therapeutic purposes in regards to tendonitis, also known as tennis elbow. Additionally, the present invention may be used to engage and strengthen additional muscles of the arm by acting as a simple weight. The overall weight of the present invention may be adjusted such that the user may utilize the present invention as a free-weight.

DETAIL DESCRIPTIONS OF THE INVENTION

All illustrations of the drawings are for the purpose of describing selected versions of the present invention and are not intended to limit the scope of the present invention.

The present invention is related to specialized exercise equipment. More specifically, the present invention is a free-weight exercise device which targets and engages the muscles of the forearm through the application of a torsional force on the hands of the user. The resistance, i.e. torsional force, felt by the user is easily adjustable, thus allowing the user to create an exercise routine that is tailored to his or her needs and athletic ability. In addition to engaging the wrist and forearm of the user, the present invention also works as a simple adjustable free-weight, thus engaging additional muscle groups of the arm.

Figure 1:
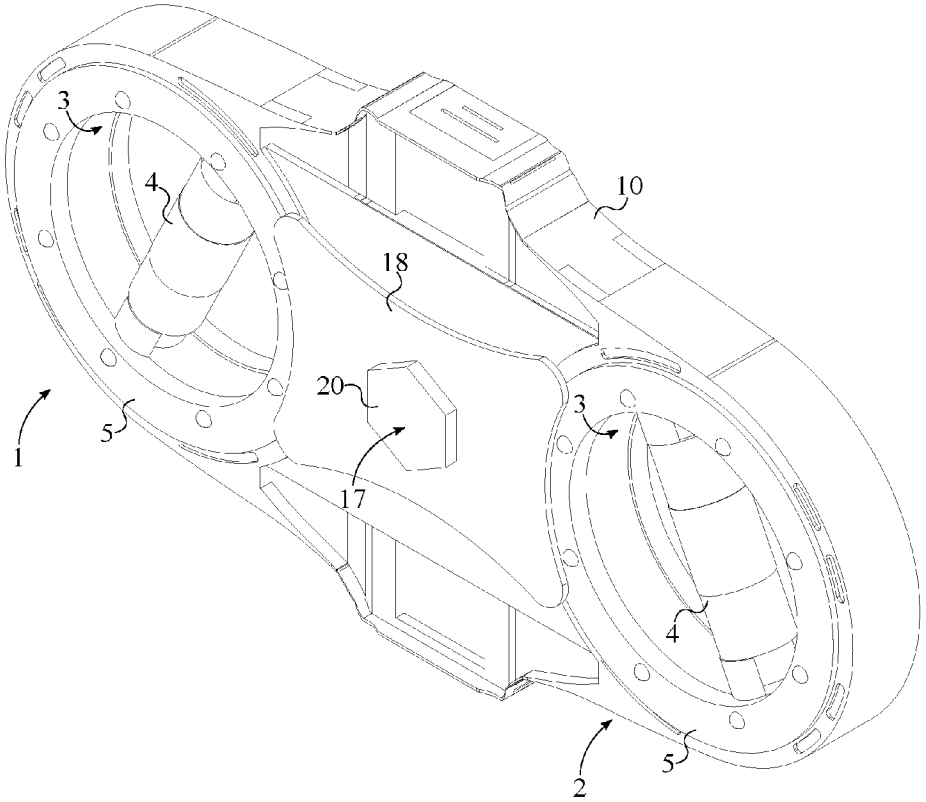
FIG. 1 is a perspective view of the present invention.

Referring to FIG. 1, in its simplest embodiment, the present invention comprises a planar framing body 10, a first grip assembly 1, a second grip assembly 2, and an adjustable resistance mechanism 17. The planar framing body 10 supports and houses the first grip assembly 1, the second grip assembly 2, and the adjustable resistance mechanism 17. The planar framing body 10 preferably has an overall oval/oblong shape when viewed front the front perspective. Although alternative designs and shapes may also be utilized in alternative embodiments of the present invention. In one embodiment, the planar framing body 10 is composed of rigid metal in order to increase the longevity of the present invention. In another embodiment, the planar framing body 10 is composed of a strong plastic to reduce manufacturing costs as well as to decrease the overall weight of the present invention. In yet another embodiment, the planar framing body 10 is composed of a mixture between metal and plastic.

The first grip assembly 1 and the second grip assembly 2 act as the interface of the present invention, providing the user with engagement points for the present inventions. The first grip assembly 1 and the second grip assembly 2 are positioned offset to each other across the planar framing body 10 which allows the first grip assembly 1 and the second grip assembly 2 to be ergonomically spaced apart from each other. Additionally, the first grip assembly 1 and the second grip assembly 2 each comprise a circular hole 3, an elongated handle 4, and rotating ring 5. The circular hole 3 perpendicularly traverses through the planar framing body 10. The circular hole 3 is sized to fully receive a human hand. The rotating ring 5 supports the elongated handle 4 and allows for rotational translation relative to the planar framing body 10. The rotating ring 5 is shaped and sized in order to be positioned concentrically within the circular hole 3. Furthermore, the rotating ring 5 is perimetrically and slidably engaged to the planar framing body 10, thus allowing the rotating ring 5 to spin freely within the circular hole 3. A variety of methods may be used in order to allow for said freely spinning motion including, but not limited to, bearings, rollers, wheels, friction-based connection, and other comparable methods. The elongated handle 4 acts as the gripping element for the user's hand. The elongated handle 4 has a cylindrical shape and is diametrically mounted across the rotating ring 5. As a result, the elongated handle 4 is oriented perpendicular to a rotation axis 6 of the rotating ring 5. This ensures that when the user grasps the elongated handle 4, the rotation axis 6 of the rotating ring 5 concentrically aligns with the length of the user's arm.

Figure 2:
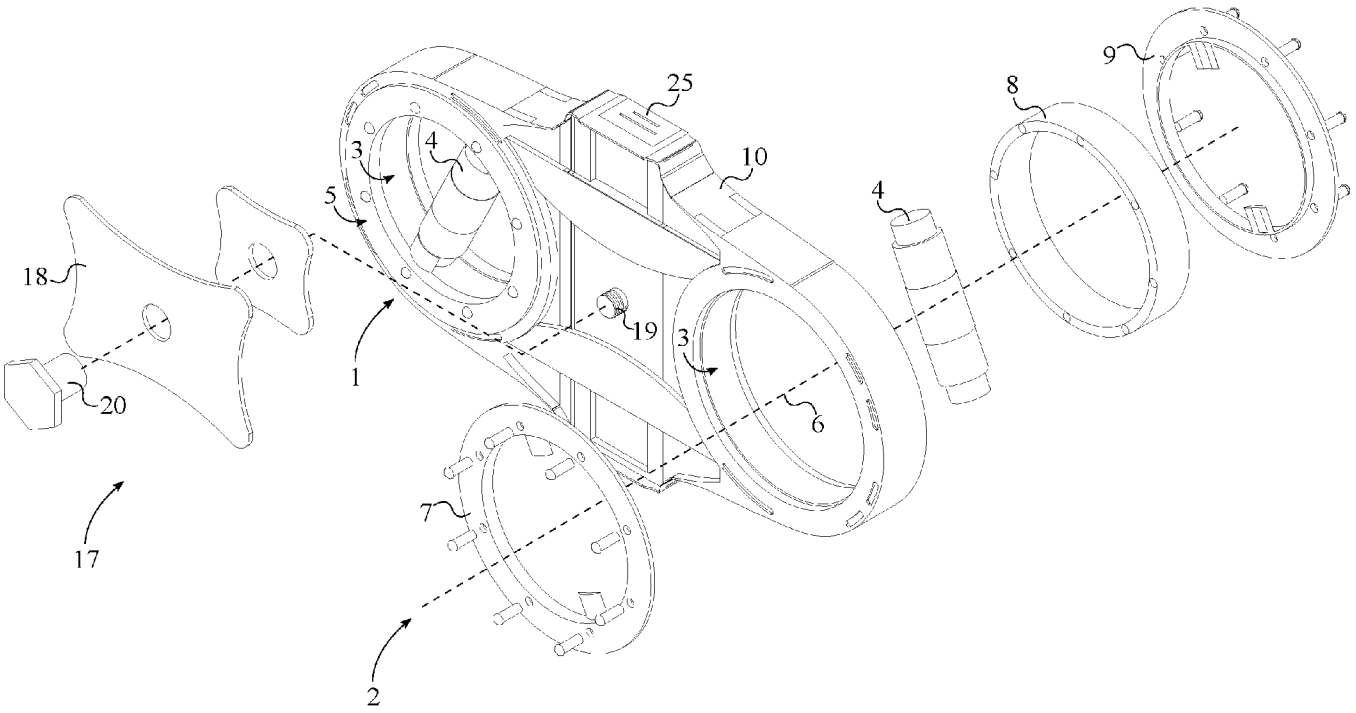
FIG. 2 is a partially exploded view of the present invention.

Referring to FIG. 2, the adjustable resistance mechanism 17 applies a resistance force onto the rotating ring 5 of the first grip assembly 1 and the rotating ring 5 of the second grip assembly 2. In general, the adjustable resistance mechanism 17 opposes the rotating ring 5 from rotating relative to the planar framing body 10. As a result, the resistance force is applied onto the user's hand in the form of a torsional force. More specifically, the adjustable resistance mechanism 17 is mechanically integrated in between the rotating ring 5 of the first grip assembly 1 and the planar framing body 10. Simultaneously, the adjustable resistance mechanism 17 is mechanically integrated in between the rotating ring 5 of the second grip assembly 2 and the planar framing body 10. A variety of mechanisms and methods may be used as the adjustable resistance mechanism 17 including, but not limited to, electromagnetic induction, resistance bands, and other similar methods.

In order to utilize the present invention for forearm and wrist exercise, the user simply grasps the elongated handle 4 of the first grip assembly 1 and the elongated handle 4 of the second grip assembly 2. Then, the user rotates his or her hand about the rotation axis 6 of the rotating ring 5 clockwise and then counterclockwise, thus engaging the muscles of the forearm. This is the simplest means of utilizing the present invention, alternative means include using only one hand at a time or crossing both hands back and forth.

Referring to FIG. 2, in one embodiment, the adjustable resistance mechanism 17 comprises a pressure plate 18, a guide rod 19, and an adjustment knob 20. In this embodiment, the resistance force is the frictional force as the result of the pressure plate 18 being pressed against the rotating ring 5. The guide rod 19 supports and acts as a translating track for the pressure plate 18. The guide rod 19 is centrally positioned on the planar framing body 10, in between the first grip assembly 1 and the second grip assembly 2. More specifically, the guide rod 19 is adjacently connected to the planar framing body 10 and is oriented parallel to the rotation axis 6 of the rotating ring 5. The pressure plate 18 directly applies the resistance force onto the rotating ring 5 in the form of friction. The pressure plate 18 is positioned normal to the rotation axis 6 of the rotating ring 5 in order to increase the overlapping surface between the pressure plate 18 and the rotating ring 5. The pressure plate 18 is sized such that the pressure plate 18 overlaps and is pressed against both the rotating ring 5 of the first grip assembly 1 and the rotating ring 5 of the second grip assembly 2. This ensures that the torsional force felt by both of the user's hands is equal. The pressure plate 18 is slidably engaged along the guide rod 19, thus allowing the pressure plate 18 to translate towards and away from the rotating ring 5 and consequently varying the resistance force applied onto the rotating ring 5. Translating the pressure plate 18 towards the rotating ring 5 will increase the resistance force and translating the pressure plate 18 away from the rotating ring 5 will decrease the resistance force.

Movement of the pressure plate 18 along the guide rod 19 may be accomplished through a variety of mechanisms but the preferred method is through a threaded element, in particular the adjustment knob 20. The adjustment knob 20 allows the user to control the location of the pressure plate 18 relative to the rotating ring 5 of the first grip assembly 1 and the second grip assembly 2, and thus the is able to adjust the resistance force. The pressure plate 18 is positioned in between the adjustment knob 20 and the planar framing body 10 with the adjustment knob 20 being threadably engaged onto the guide rod 19. As a result, the adjustment knob 20 is pressed against the pressure plate 18. By rotating the adjustment knob 20, the resistance force may be increased or decreased as the threaded connection between the guide rod 19 and the adjustment knob 20 translates the adjustment knob 20, and the pressure plate 18 closer or further to the planar framing body 10. The location of the pressure plate 18 may further be controlled through the use of a spacer. The spacer offsets the pressure plate 18 from the rotating ring 5 and may be easily attached and removed along the guide rod 19.

Referring to FIG. 2, the rotating ring 5 further comprises an internal ring body 8, a front covering flange 7, and a rear covering flange 9. The internal ring body 8 is concentrically positioned within the circular hole 3. The internal ring body 8 presses against the planar framing body 10 in order to produce a minimal resistance force. The front covering flange 7 and the rear covering flange 9 lock the internal ring body 8 within the circular hole 3 without significantly obstructing movement of the internal ring body 8. More specifically, the front covering flange 7 is perpendicularly and adjacently connected around the internal ring body 8. Opposite the front covering flange 7, the rear covering flange 9 is perpendicularly and adjacently connected around the internal ring body 8. Screws, bolts, nuts, glue, welding, and other similar mechanisms may be used to connect the front covering flange 7, the internal ring body 8, and the rear covering flange 9. The front covering flange 7 and the rear covering flange 9 are sized such that the planar framing body 10 is pressed in between the front covering flange 7 and the rear covering flange 9. The front covering flange 7 is positioned such that the pressure plate 18 presses against the front covering flange 7, opposite the internal ring body 8.

Figure 3:
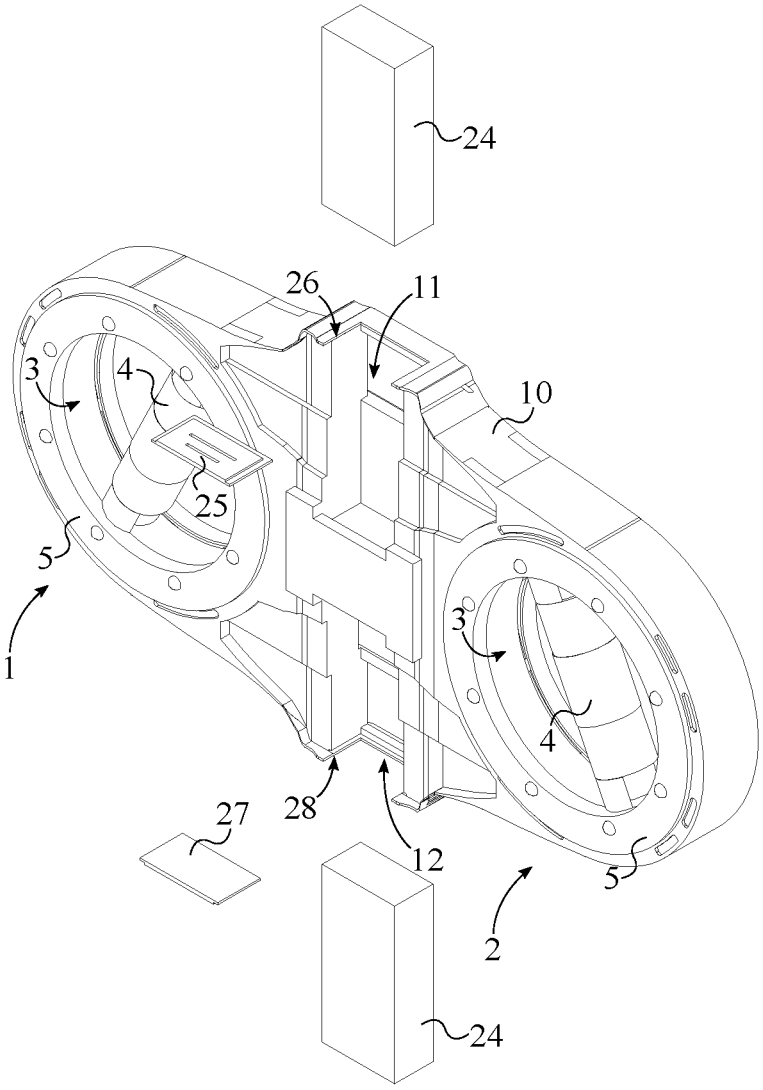
FIG. 3 is a rear partially exploded view of the present invention.

Referring to FIG. 3, the present invention further comprises a first weight 23 and a second weight 24. The first weight 23 and the second weight 24 increase the overall weight of the present invention, allowing the user to perform additional exercise by utilizing the present invention such as a free-weight. Complimentary to the first weight 23 and the second weight 24, the present invention also comprises a first weight-receiving cavity 11, a second weight-receiving cavity 12. The first weight-receiving cavity 11 and the second weight-receiving cavity 12 are positioned in between the first grip assembly 1 and the second grip assembly 2. This positions the first weight 23 and the second weight 24 in between the user's hands, ensuring equal load on both arms. The first weight-receiving cavity 11 traverses into the planar framing body 10 and is shaped/sized complimentary to the first weight 23. Similarly, the second weight 24-receiving cavity 12 traverses into the planar framing body 10, opposite to the first weight-receiving cavity 11. The second weight-receiving cavity 12 is shaped/sized complimentary to the second weight 24. The first weight 23 is mounted within the first weight-receiving cavity 11 to incrementally increase the overall weight of the present invention. Similarly, the second weight 24 is mounted within the second weight-receiving cavity 12 to further increase the overall weight of the present invention. With the additional weight, the user may engage additional muscle groups of the arm. For example, the user may rotate the first grip assembly 1 and the second grip assembly 2 while holding the present invention extended away from the body for as long as possible, thus engaging muscles of the upper arm.

In one embodiment of the present invention, the first weight 23 and the second weight 24 are rectangular extrusions with the first weight-receiving cavity 11 and the second weight-receiving cavity 12 being shaped accordingly. In this embodiment, the first weight 23 and the second weight 24 are removably mounted through the use of a first endcap 25 and a second endcap 27. More specifically, the first weight 23 is positioned within the first weight-receiving cavity 11 and locked in place by attaching the first endcap 25 onto the planar framing body 10, wherein the first endcap 25 is positioned within an opening 26 of the first weight-receiving cavity 11. Similarly, the second weight 24 is positioned within the second weight-receiving cavity 12 and locked in place by attaching the second endcap 27 onto the planar framing body 10, wherein the second endcap 27 is positioned within an opening 28 of the second weight-receiving cavity 12. This allows the user to easily vary the overall weight of the present invention. The first weight 23 and the second weight 24 may come in a variety of weights to allow for further customization of the present invention.

Figure 4:
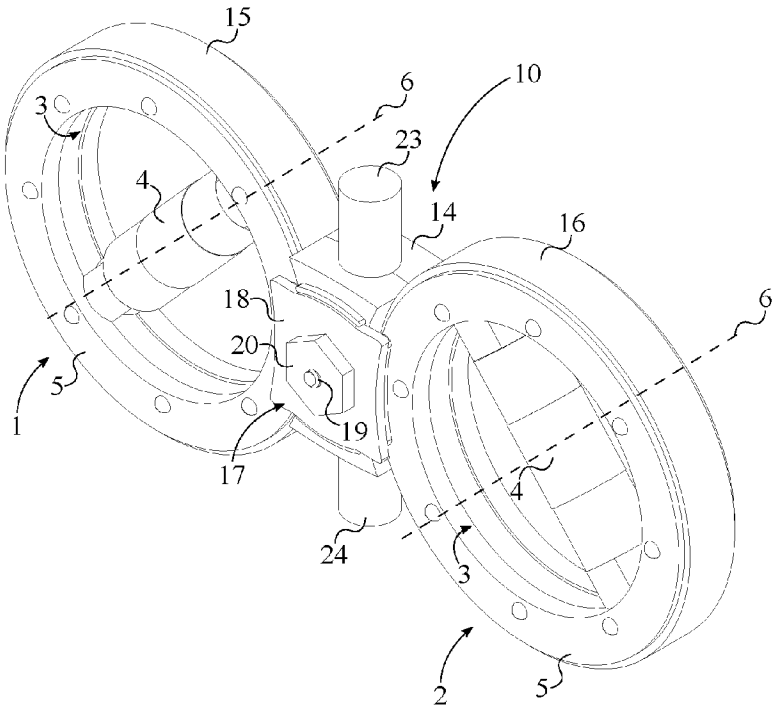
FIG. 4 is a perspective view of an alternative embodiment of the present invention.
Figure 5:
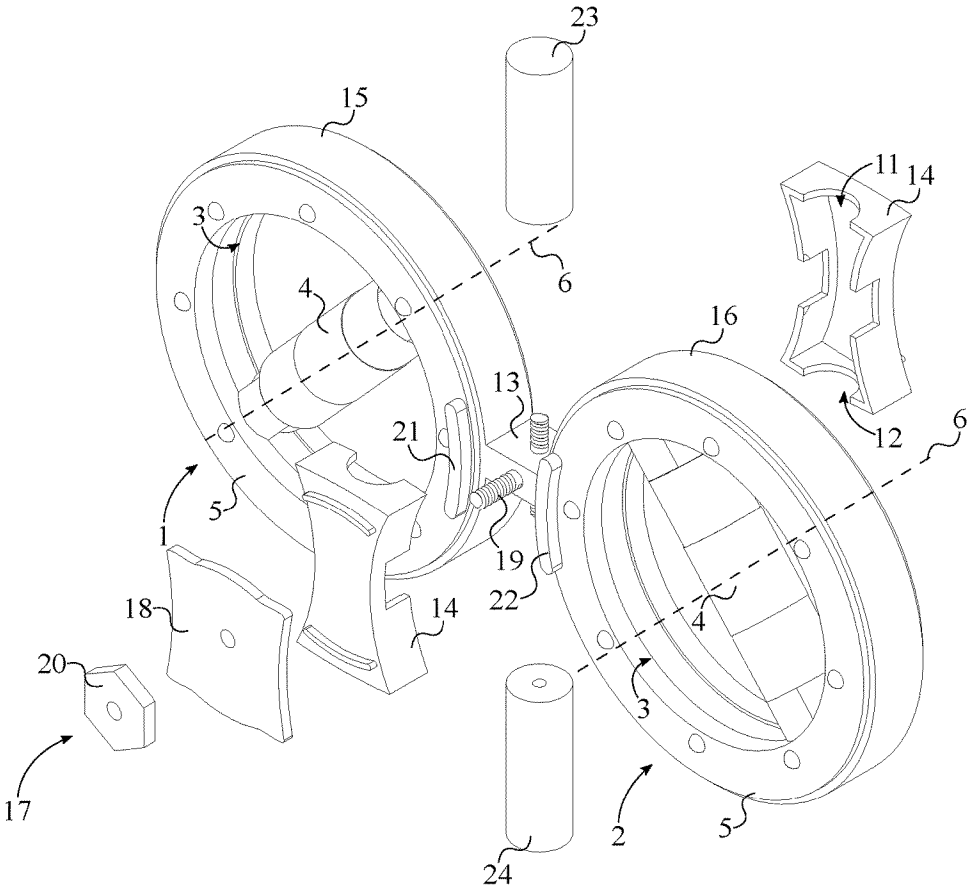
FIG. 5 is a partially exploded view of the alternative embodiment of the present invention.

Referring to FIG. 4 and FIG. 5, in an alternative embodiment of the present invention, the planar framing body 10 is composed of metal and comprises a first annular portion 15, a second annular portion 16, a bridge 13, and an enclosure 14. This embodiment is efficiently designed in order to withstand daily use in a variety of environments. The first annular portion 15 is positioned around the circular hole 3 of the first grip assembly 1. Similarly, the second annular portion 16 is positioned around the circular hole 3 of the second grip assembly 2. The bridge 13 structurally connects the first annular portion 15 and the second annular portion 16. In particular, the bridge 13 is positioned in between the rotating ring 5 of the first grip assembly 1 and the rotating ring 5 of the second grip assembly 2. Additionally, the bridge 13 is connected in between the first annular portion 15 and the second annular portion 16 as seen in FIG. 5. Furthermore, the bridge 13 is positioned within the enclosure 14. The enclosure 14 supports the first weight 23, the second weight 24, and the adjustable resistance mechanism 17.

In this embodiment, the first weight 23 and the second weight 24 are each cylindrically shaped. The first weight-receiving cavity 11 is shaped and sized complimentary to the first weight 23 and traverses into the enclosure 14. Similarly, the second weight-receiving cavity 12 is shaped and sized complimentary to the second weight 24 and traverses into the enclosure 14, opposite the first weight-receiving cavity 11. This aligns the first weight 23 and the second weight 24, thus balancing the present invention. The first weight 23 traverses into the first weight-receiving cavity 11 and is detachably attached to the bridge 13. Similarly, the second weight 24 traverses into the second weight-receiving cavity 12 and is detachably attached to the bridge 13. In one embodiment, the first weight 23 and the second weight 24 are each threadably engaged to the bridge 13, thus allowing the user to easily vary the total weight of the present invention.

In this embodiment of the present invention, the adjustable resistance mechanism 17 further comprises a first friction pad 21 and a second friction pad 22. The first friction pad 21 and the second friction pad 22 increase the resistance force. The first friction pad 21 is positioned in between the pressure plate 18 and the rotating ring 5 of the first grip assembly 1 and is connected adjacent to the pressure plate 18. Similarly, the second friction pad 22 is positioned in between the pressure plate 18 and the rotating ring 5 of the first grip assembly 1, and is connected adjacent to the pressure plate 18. The first friction pad 21 and the second friction pad 22 also act as a spacer in order to mechanically couple the pressure plate 18 to the rotating ring 5 of the first grip assembly 1 and to the rotating ring 5 of the second grip assembly 2.

Although the invention has been explained in relation to its preferred embodiment, it is to be understood that many other possible modifications and variations can be made without departing from the spirit and scope of the invention as hereinafter claimed.

What is claimed is:

1. A wrist and forearm exercise device comprising:
- a first grip assembly;
- a second grip assembly;
- a planar framing body;
- an adjustable resistance mechanism;
- the first grip assembly and the second grip assembly each comprising a circular hole, an elongated handle, and a rotating ring;
- the first grip assembly and the second grip assembly being positioned offset to each other across the planar framing body;
- the circular hole perpendicularly traversing through the planar framing body;
- the rotating ring being concentrically positioned within the circular hole;
- the rotating ring being perimetrically and slidably engaged to the planar framing body;
- the elongated handle being diametrically mounted across the rotating ring;
- the elongated handle being orientated perpendicular to a rotation axis of the rotating ring;
- the adjustable resistance mechanism being mechanically integrated in between the rotating ring of the first grip assembly and the planar framing body;
- the adjustable resistance mechanism being mechanically integrated in between the rotating ring of the second grip assembly and the planar framing body;
- a first weight;
- a second weight;
- a first weight-receiving cavity;
- a second weight-receiving cavity;
- the first weight-receiving cavity and the second weight-receiving cavity being positioned in between the first grip assembly and the second grip assembly;
- the first weight-receiving cavity traversing into the planar framing body;
- the second weight-receiving cavity traversing into the planar framing body, opposite to the first weight-receiving cavity;
- the first weight being mounted within the first weight-receiving cavity; and
- the second weight being mounted within the second weight-receiving cavity.

2. The wrist and forearm exercise device as claimed in claim 1 comprising:
- the adjustable resistance mechanism comprising a pressure plate and a guide rod;
- the guide rod being positioned in between the first grip assembly and the second grip assembly;
- the guide rod being adjacently connected to the planar framing body;
- the guide rod being oriented parallel to the rotation axis of the rotating ring;
- the pressure plate being positioned normal the rotation axis of the rotating ring;
- the pressure plate being slidably engaged along the guide rod; and
- the pressure plate being pressed against the rotating ring of the first grip assembly and the rotating ring of the second grip assembly.

3. The wrist and forearm exercise device as claimed in claim 2 comprising:
- the adjustable resistance mechanism comprising an adjustment knob;
- the pressure plate being positioned in between the adjustment knob and the planar framing body;
- the adjustment knob being threadably engaged onto the guide rod; and
- the adjustment knob being pressed against the pressure plate.

4. The wrist and forearm exercise device as claimed in claim 2 comprising:

the adjustable resistance mechanism comprising a first friction pad and a second friction pad;

the first friction pad being positioned in between the pressure plate and the rotating ring of the first grip assembly;

the first friction pad being connected adjacent to the pressure plate;

the second friction pad being positioned in between the pressure plate and the rotating ring of the second grip assembly; and the second friction pad being connected adjacent to the pressure plate.

5. The wrist and forearm exercise device as claimed in claim 1 comprising:

the rotating ring comprising a front covering flange, an internal ring body, and a rear covering flange;

the internal ring body being concentrically positioned within the circular hole;

the front covering flange being perpendicularly and adjacently connected around the internal ring body;

the rear covering flange being perpendicular and adjacently connected around the internal ring body, opposite the front covering flange;

the planar framing body being pressed in between the front covering flange and the rear covering flange; and a pressure plate of the adjustable resistance mechanism being pressed against the front covering flange, opposite the internal ring body.

6. The wrist and forearm exercise device as claimed in claim 1 comprising:

a first endcap;

the first endcap being positioned within an opening of the first weight-receiving cavity; and the first endcap being attached onto the planar framing body.

7. The wrist and forearm exercise device as claimed in claim 1 comprising:

a second endcap;

the second endcap being positioned within an opening of the second weight-receiving cavity; and the second endcap being attached onto the planar framing body.

8. The wrist and forearm exercise device as claimed in claim 1 comprising:

the planar framing body comprising the first weight-receiving cavity, the second weight-receiving cavity, a bridge, and an enclosure;

the bridge being positioned in between the rotating ring of the first grip assembly and the rotating ring of the second grip assembly;

the bridge being positioned within the enclosure;

the first weight-receiving cavity traversing into the enclosure;

the second weight-receiving cavity traversing into the enclosure, opposite to the first weight receiving cavity;

the first weight traversing into the first weight-receiving cavity;

the second weight traversing into the second weight-receiving cavity; and the first weight and the second weight being detachably attached to the bridge.

9. The wrist and forearm exercise device as claimed in claim 8 comprising:

the first weight being threadably engaged to the bridge; and the second weight being threadably engaged to the bridge.

10. The wrist and forearm exercise device as claimed in claim 8 comprising:

the planar framing body comprising a first annular portion and a second annular portion;

the first annular portion being positioned around the circular hole of the first grip assembly;

the second annular portion being positioned around the circular hole of the second grip assembly; and the bridge being connected in between the first annular portion and the second annular portion.

* * * * *